US012298069B2

(12) United States Patent
Allard et al.

(10) Patent No.: US 12,298,069 B2
(45) **Date of Patent: *May 13, 2025**

(54) VACUUM INSULATED APPLIANCE WITH PRESSURE MONITORING

(71) Applicant: WHIRLPOOL CORPORATION, Benton Harbor, MI (US)

(72) Inventors: Paul B. Allard, Coloma, MI (US); Sunil S. Ekshinge, Pune (IN); Alberto Regio Gomes, St. Joseph, MI (US); Abhay Naik, Stevensville, MI (US); Sanjesh Kumar Pathak, Stevensville, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/618,621

(22) Filed: Mar. 27, 2024

(65) Prior Publication Data

US 2024/0240854 A1 Jul. 18, 2024

Related U.S. Application Data

(63) Continuation of application No. 17/717,421, filed on Apr. 11, 2022, now Pat. No. 11,959,696.

(51) Int. Cl.
*F25D 29/00* (2006.01)
*F25D 23/06* (2006.01)

(52) U.S. Cl.
CPC ..... *F25D 29/006* (2013.01); *F25D 23/065* (2013.01); *F25D 2201/126* (2013.01);
(Continued)

(58) Field of Classification Search
CPC ..... F25D 2201/126; F25D 2201/14; F25D 23/06; F25D 23/065; F25D 2500/04; F25D 2700/12; F25D 2700/14; F25D 29/006
See application file for complete search history.

(56) References Cited

U.S. PATENT DOCUMENTS 2,801,526 A * 8/1957 Solley, Jr. ..... F25D 17/062 62/DIG. 13
5,361,598 A 11/1994 Roseen
(Continued)

FOREIGN PATENT DOCUMENTS

AU 2016213928 A1 9/2016
CN 103926272 A 7/2014
(Continued)

*Primary Examiner* — Filip Zec
(74) *Attorney, Agent, or Firm* — Price Heneveld LLP

(57) ABSTRACT

A method of measuring pressure includes the steps of (1) providing a vacuum cabinet with a storage compartment and an insulating space, and three temperature sensors; (2) sensing a first temperature level of an interior wall of the storage compartment; (3) sensing an ambient temperature level within the storage compartment; (4) sensing a second temperature level of an exterior wall of the storage compartment; (5) calculating an overall heat transfer coefficient (Q) using the ambient temperature level, the first temperature level, and a convective heat transfer coefficient for the interior wall of the storage compartment; (6) calculating a temperature differential between the second and first temperature levels; (7) determining a conductivity level (K) using the temperature differential, the overall heat transfer coefficient (Q) and a thickness of the insulating space; and (8) determining a pressure level (P) within the insulating space using the conductivity level (K).

17 Claims, 7 Drawing Sheets

(52) U.S. Cl.
CPC ..... *F25D 2201/14* (2013.01); *F25D 2500/04* (2013.01); *F25D 2700/12* (2013.01); *F25D 2700/14* (2013.01)

(56) References Cited

U.S. PATENT DOCUMENTS

| | | | | |
|---|---|---|---|---|
| 6,955,196 | B2 | 10/2005 | Giudici et al. | |
| 7,400,999 | B2 | 7/2008 | Caps | |
| 7,472,556 | B2 | 1/2009 | Kirby et al. | |
| 7,591,141 | B2 * | 9/2009 | Wetekamp | F25D 11/02 62/340 |
| 7,685,837 | B2 * | 3/2010 | Ritchie | F25D 25/025 62/419 |
| 8,047,058 | B2 | 11/2011 | Caps | |
| 9,182,158 | B2 * | 11/2015 | Wu | F25B 5/02 |
| 9,791,205 | B2 * | 10/2017 | Mukherjee | F25D 23/063 |
| 10,663,217 | B2 * | 5/2020 | Kuehl | F25D 11/00 |
| 10,876,786 | B2 | 12/2020 | Jung et al. | |
| 12,078,404 | B2 * | 9/2024 | Leidens | F25D 21/04 |
| 2005/0175809 | A1 | 8/2005 | Hirai et al. | |
| 2009/0255289 | A1 * | 10/2009 | Friedmann | F25C 5/046 62/320 |
| 2010/0050681 | A1 * | 3/2010 | Ryu | F25D 11/022 62/344 |
| 2013/0199233 | A1 | 8/2013 | Coulter et al. | |
| 2016/0131605 | A1 | 5/2016 | Hamrouni et al. | |
| 2018/0216872 | A1 | 8/2018 | Jung et al. | |
| 2019/0128593 | A1 * | 5/2019 | Deka | F16L 59/065 |
| 2020/0017011 | A1 | 1/2020 | Nam et al. | |

FOREIGN PATENT DOCUMENTS

| | | | |
|---|---|---|---|
| CN | 104122032 | A | 10/2014 |
| DE | 10117021 | A1 | 10/2002 |
| EP | 3954956 | A1 | 2/2022 |
| WO | 2021063877 | A1 | 4/2021 |

* cited by examiner

VACUUM INSULATED APPLIANCE WITH PRESSURE MONITORING

CROSS-REFERENCE TO RELATED APPLICATION

This application is a continuation of U.S. patent application Ser. No. 17/717,421, now U.S. Pat. No. 11,959,696 filed on Apr. 11, 2022, entitled VACUUM INSULATED APPLIANCE WITH PRESSURE MONITORING, the entire disclosure of which is hereby incorporated by reference.

BACKGROUND

The present device generally relates to an appliance, and more specifically, to an appliance having a vacuum insulated structure with pressure monitoring features.

SUMMARY

In at least one aspect, a refrigerator includes a vacuum insulated cabinet structure having a refrigerator compartment and an exterior wrapper with an insulating space disposed therebetween. The refrigerator compartment is positioned within the vacuum insulated cabinet structure and includes an interior wall. The exterior wrapper includes an exterior wall that is separated from the interior wall of the refrigerator compartment to define a thickness of the insulating space. A first sensor is positioned on the interior wall of the refrigerator compartment and is configured to sense a first temperature level of the interior wall of the refrigerator compartment. A second sensor is positioned on the exterior wall of the exterior wrapper and is configured to sense a second temperature level of the exterior wall of the exterior wrapper. A third sensor positioned within the refrigerator compartment and is configured to sense an ambient temperature level within the refrigerator compartment. A controller is operably coupled to the first, second and third sensors for receiving temperature level data therefrom. The controller is configured to calculate an overall heat transfer coefficient (Q) using the ambient temperature level, the first temperature level, and a convective heat transfer coefficient for the interior wall of the storage compartment; calculate a temperature differential between the second temperature level and the first temperature level; determine a conductivity level (K) using the temperature differential, the overall heat transfer coefficient (Q) and the thickness of the insulating space; and determine a pressure level (P) within the insulating space using the conductivity level (K).

In at least another aspect, a vacuum insulated cabinet structure includes a storage compartment and an insulating space positioned between interior and exterior walls of the storage compartment. A first temperature sensor is positioned on the interior wall of the storage compartment and is configured to sense a first temperature level of the interior wall of the storage compartment. A second temperature sensor is positioned on the exterior wall of the storage compartment and is configured to sense a second temperature level of the exterior wall of the storage compartment. A third temperature sensor is positioned outside of the storage compartment and is configured to sense an ambient temperature level for an environment in which the storage compartment is disposed. A controller is operably coupled to the first, second and third temperature sensors for receiving temperature level data therefrom. The controller is configured to (i) calculate a first temperature differential between the second temperature level and the first temperature level; (ii) calculate an overall heat transfer coefficient (Q) using the ambient temperature level, the second temperature level, and a convective heat transfer coefficient for the exterior wall of the storage compartment; (iii) determine a first conductivity level (K) using the first temperature differential, the overall heat transfer coefficient (Q) and a thickness of the insulating space; and (iv) determine a first pressure level (P) within the insulating space using the first conductivity level (K).

In at least another aspect, a method of measuring insulation performance includes the steps of (i) providing a storage compartment surrounded by an insulation space, a first temperature sensor positioned on a first side of the insulation space, a second temperature sensor positioned on a second side of the insulation space, a third temperature sensor positioned within the storage compartment, and a controller operably coupled to the first, second and third temperature sensors; (ii) sensing a first temperature level (T1) using the first temperature sensor; (iii) sensing a second temperature level (T2) using the second temperature sensor; (iv) calculating a temperature differential (ΔT) by subtracting the first temperature level (T1) from the second temperature level (T2); (v) sensing an ambient temperature level ($T_i$) within the storage compartment using the third temperature sensor; (vi) calculating an overall heat transfer coefficient (Q) using the ambient temperature level ($T_i$), the first temperature level (T1), and a convective heat transfer coefficient for the first side of the storage compartment; (vii) determining a first conductivity level (K) using the temperature differential (ΔT), the overall heat transfer coefficient (Q) and a thickness of the insulating space; and (viii) determining a first pressure level (P) within the insulating space using the first conductivity level (K).

These and other features, advantages, and objects of the present device will be further understood and appreciated by those skilled in the art upon studying the following specification, claims, and appended drawings.

DETAILED DESCRIPTION OF EMBODIMENTS

Figure 1:
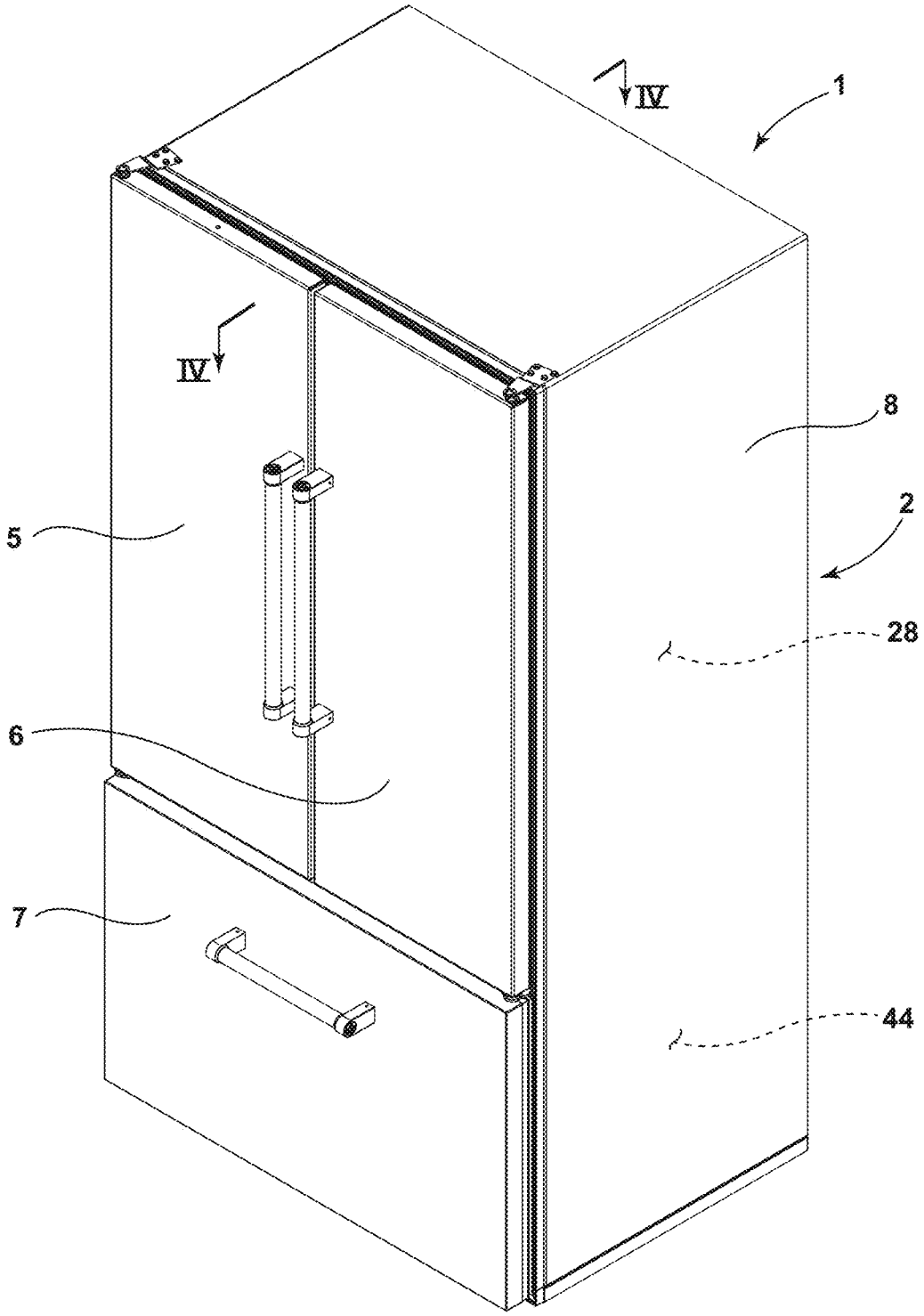
FIG. 1 is a top perspective view of a refrigerator.

The present illustrated embodiments reside primarily in combinations of method steps and apparatus components related to an anti-condensation feature for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

The terms "substantial," "substantially," and variations thereof, as used herein, are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

With reference to FIG. 1, an appliance is shown in the form of a refrigerator 1. The refrigerator 1 includes a cabinet structure 2 which, in the embodiment of FIG. 1, further includes a refrigerator compartment 28 positioned above a freezer compartment 44. The refrigerator compartment 28 and the freezer compartment 44 may be referred to herein as compartments 28, 44 and may also be referred to herein on an individual basis as a storage compartment. Doors 5 and 6 are provided to selectively provide access to the refrigerator compartment 28, while a drawer 7 is used to provide access to the freezer compartment 44. The cabinet structure 2 is surrounded by an exterior wrapper 8. The cabinet structure 2 of the refrigerator 1 may be a vacuum insulated cabinet structure and may be referred to herein as such. The configuration of the refrigerator 1 as shown in FIG. 1 is exemplary only and the present concept is contemplated for use in all refrigerator styles including, but not limited to, side-by-side refrigerators, whole refrigerator and freezers, and refrigerators with upper freezer compartments.

Figure 2:
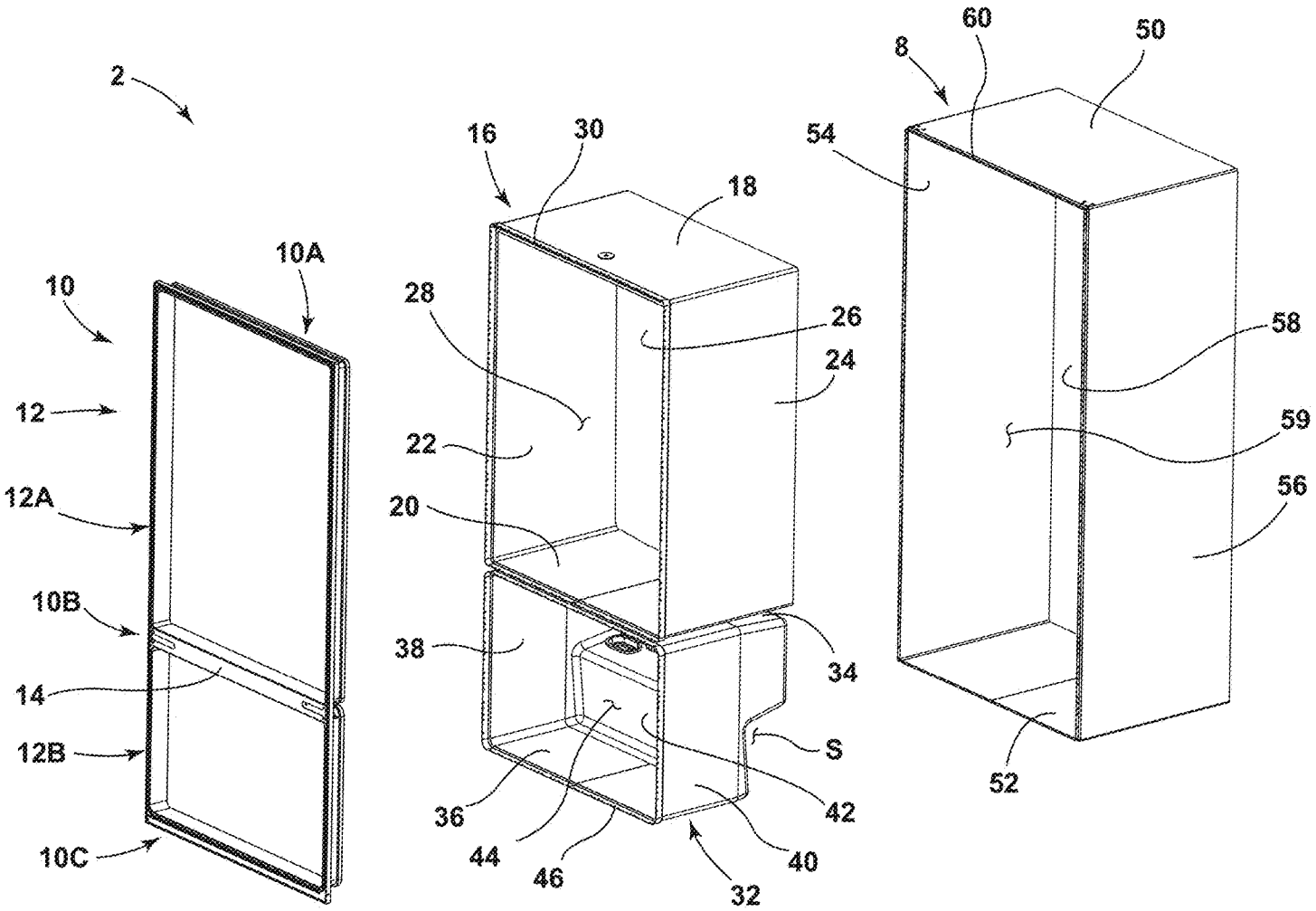
FIG. 2 is an exploded top perspective view of a cabinet structure from the refrigerator of FIG. 1.

Referring now to FIG. 2, the cabinet structure 2 generally includes a trim breaker 10. In the embodiment shown in FIG. 2, the trim breaker 10, or thermal bridge, includes a frame 12 having an upper opening 12A and a lower opening 12B with a mullion portion 14 disposed therebetween. The trim breaker 10 further includes an upper portion 10A, a middle portion 10B and a lower portion 10C.

As further shown in the embodiment of FIG. 2, the cabinet structure 2 further includes a refrigerator liner 16 having a top wall 18, a bottom wall 20, opposed sidewalls 22, 24, and a rear wall 26. Together, the walls 18, 20, 22, and 24 of the refrigerator liner 16 cooperate to define the refrigerator compartment 28 when the cabinet structure 2 is assembled. The refrigerator liner 16 further includes a front edge 30 disposed on a front portion thereof. The front edge 30 is disposed along the top wall 18, the bottom wall 20 and the opposed sidewalls 22, 24 in a quadrilateral ring configuration.

As further shown in the embodiment of FIG. 2, a freezer liner 32 is provided and includes a top wall 34, a bottom wall 36, opposed sidewalls 38, 40, and a rear wall 42. Together, the walls 34, 36, 38, 40 and 42 of the freezer liner 32 cooperate to define the freezer compartment 44. The rear wall 42 is shown in FIG. 2 as being a contoured rear wall that provides a spacing S for housing mechanical equipment 43 (FIG. 4) for cooling both the refrigerator compartment 28 and freezer compartment 44. Such equipment may include a compressor, a condenser, an expansion valve, an evaporator, a plurality of conduits, and other related components used for cooling the refrigerator and freezer compartments 28, 44, as further described below with specific reference to FIG. 5. As further shown in the embodiment of FIG. 2, the freezer liner 32 includes a front edge 46 disposed on a front portion thereof. The front edge 46 is disposed along the top wall 34, the bottom wall 36 and the opposed sidewalls 38, 40 in a quadrilateral ring configuration. In assembly, the front edge 30 of the refrigerator liner 16 and the front edge 46 of the freezer liner 32 are configured to couple with coupling portions disposed about the upper and lower openings 12A, 12B of the trim breaker 10.

As further shown in FIG. 2, the cabinet structure 2 also includes the exterior wrapper 8. In the embodiment of FIG. 2, the exterior wrapper 8 includes a top wall 50, a bottom wall 52, opposed sidewalls 54, 56, and a rear wall 58 which cooperate to define a cavity 59. The exterior wrapper 8 further includes a front edge 60 which is disposed along the top wall 50, the bottom wall 52, and the opposed sidewalls 54, 56 in a quadrilateral ring configuration. In assembly, the front edge 60 of the exterior wrapper 8 is coupled to coupling portions of the trim breaker 10 around the refrigerator liner 16 and the freezer liner 32. In this way, the trim breaker 10 interconnects the exterior wrapper 8 and the refrigerator liner 16 and the freezer liner 32 when assembled. Further, the refrigerator liner 16 and the freezer liner 32 are received within the cavity 59 of the exterior wrapper 8 when assembled, such that an insulating space 62 (FIG. 3) is defined between the outer surfaces of the refrigerator liner 16 and the freezer liner 32 relative to the inner surfaces of the exterior wrapper 8. The insulating space 62 can be used to create a vacuum insulated cavity provided at a negative pressure, or can be used to receive an insulation material to insulate the refrigerator compartment 28 and the freezer compartment 44, or both. For example, the insulating space 62 may be evacuated to a negative pressure and also contain an insulation material, such as a polyurethane foam insulation material disposed therein. In assembly, the insulating space 62 surrounds the refrigerator liner 16 and the freezer liner 32 to insulate the same, with the exception of the front portions thereof, which are accessible via doors 5, 6 and drawer 7.

Figure 3:
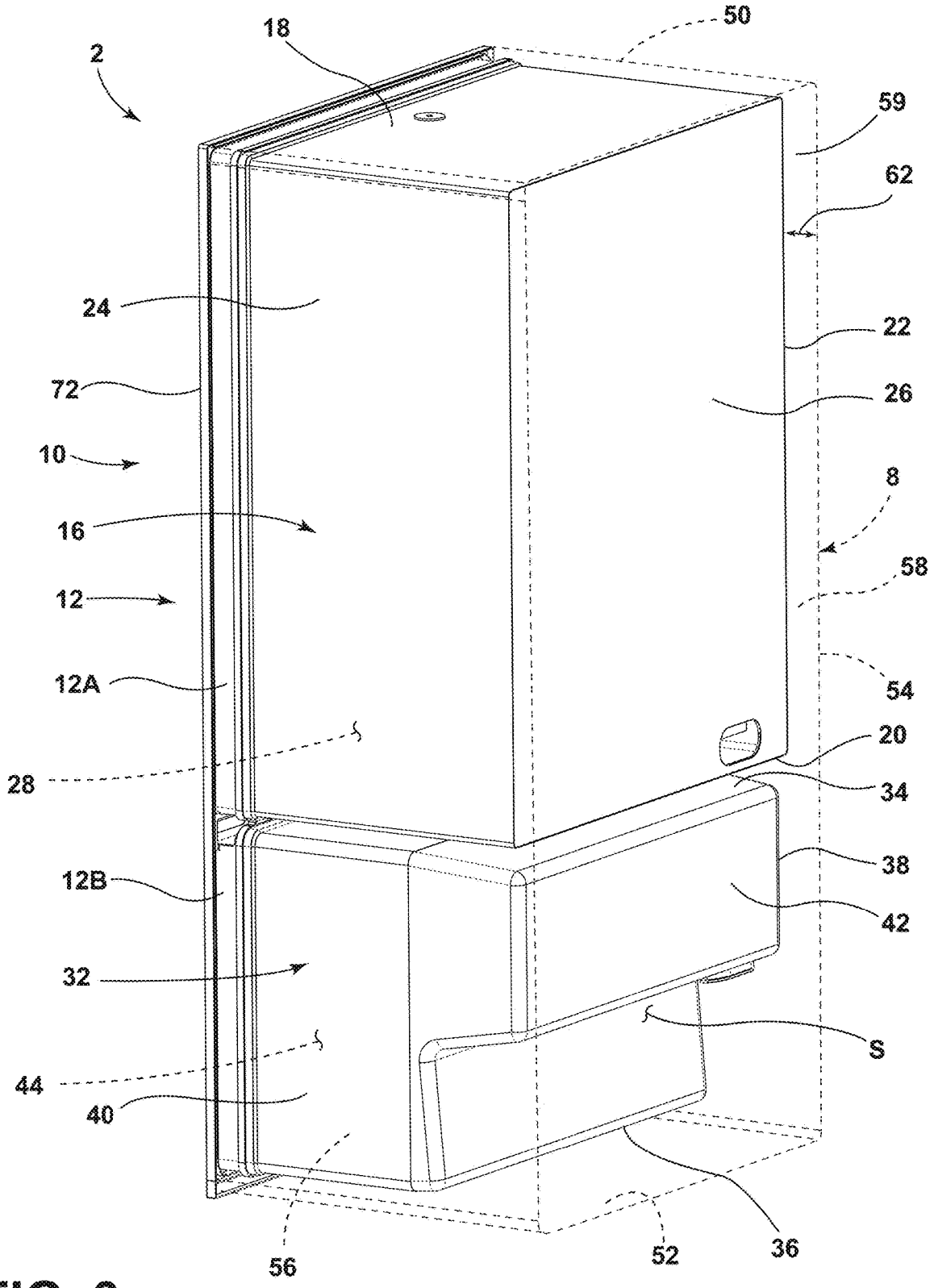
FIG. 3 is a rear top perspective view of the cabinet structure of FIG. 2 as assembled.

When the cabinet structure 2 is contemplated to be a vacuum insulated cabinet structure, the trim breaker 10 may be configured to provide an air-tight connection between the exterior wrapper 8 and the liners 16, 32 which allows for a vacuum to be held between the trim breaker 10, the exterior wrapper 8 and the liners 16, 32 in the insulating space 62 (FIG. 3). The trim breaker 10 may also be formed from any suitable material that is substantially impervious to gasses to maintain a vacuum in the insulating space 62, if so desired.

Referring now to FIG. 3, when the cabinet structure 2 is assembled, the trim breaker 10 connects to the front edge 60 (FIG. 2) of the exterior wrapper 8, and further connects to the front edge 30 (FIG. 2) of the refrigerator liner 16, and to the front edge 46 (FIG. 2) of the freezer liner 32. In this way, the trim breaker 10 interconnects the exterior wrapper 8 and the liners 16, 32. When the refrigerator 1 (FIG. 1) is in use, the exterior wrapper 8 is typically exposed to ambient room temperature air, whereas the liners 16, 32 are generally exposed to refrigerated air in the refrigerator compartment 28 or the freezer compartment 44. With the trim breaker 10 being made of a material that is substantially non-conductive with respect to heat, the trim breaker 10 reduces transfer of heat from the exterior wrapper 8 to the liners 16, 32. As shown in FIG. 3, the insulating space 62 substantially surrounds the refrigerator compartment 28 and the freezer compartment 44.

Figure 4:
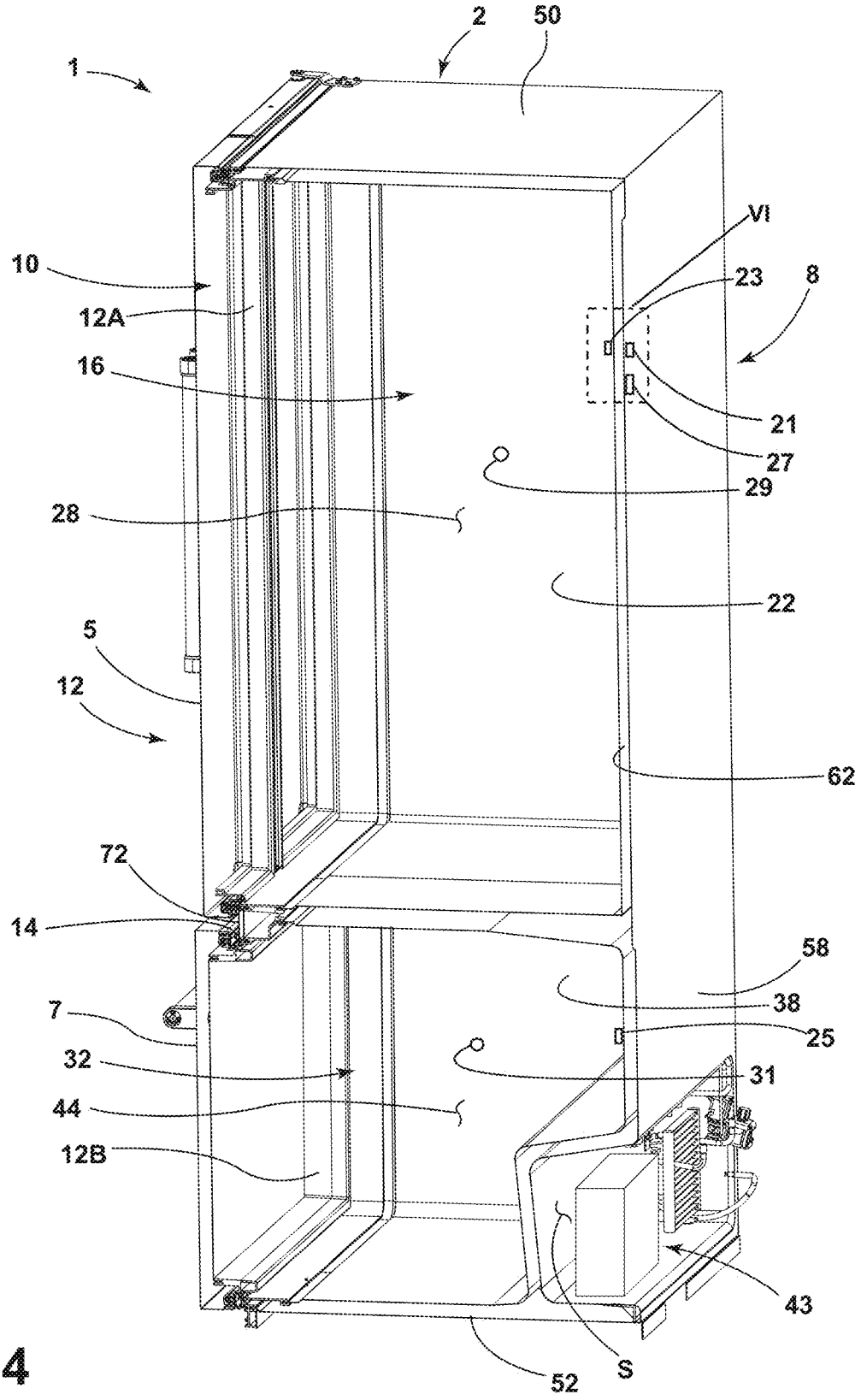
FIG. 4 is a cross-sectional view of the refrigerator of FIG. 1 taken at line IV.

Referring now to FIG. 4, the refrigerator 1 is shown in a cross-sectional view having the refrigerator liner 16 and the freezer liner 32 coupled to the trim breaker 10 at upper and lower openings 12A, 12B, respectively. Further, the exterior wrapper 8 is also coupled to the trim breaker 10, such that the trim breaker 10 interconnects the exterior wrapper 8 with the refrigerator liner 16 and the freezer liner 32. Specifically, the trim breaker 10 of the present concept is coupled to the liners 16, 32 and the exterior wrapper 8 to hermetically seal the components together as a unitary whole as shown in FIG. 3. As further shown in FIG. 4, the refrigerator 1 includes a sensor 23 positioned within the refrigerator compartment 28 and a sensor 25 positioned within the freezer compartment 44. The refrigerator 1 further includes a sensor 21 positioned on the wrapper 8. Specifically, in the embodiment shown in FIG. 4, the sensor 21 is positioned on the rear wall 58 of the exterior wrapper 8. As such, the sensors 23 and 21 are positioned on opposite sides of the insulating space 62 adjacent the refrigerator compartment 28. Similarly, the sensors 25 and 21 are positioned on opposite sides of the insulating space 62 with sensor 25 positioned in the freezer compartment 44. As further shown in FIG. 4, the refrigerator 1 further includes a sensor 27 positioned on the wrapper 8. Specifically, in the embodiment shown in FIG. 4, the sensor 27 is positioned on the rear wall 58 of the exterior wrapper 8. It is contemplated that the sensors 21 and 27 may be positioned on other walls of the exterior wrapper 8, the sensor 23 can be positioned on other walls of the refrigerator liner 16 within the refrigerator compartment 28, and the sensor 25 may be positioned on other walls of the freezer liner 32 within the freezer compartment 44. It is further contemplated that the sensor 27 may be positioned in a remote location for measuring ambient temperature levels, as further described below. As further shown in FIG. 4, the refrigerator 1 further includes a sensor 29 positioned on a sidewall of the refrigerator liner 16. Specifically, in the embodiment shown in FIG. 4, the sensor 29 is positioned on the sidewall 22 of the refrigerator liner 16. As further shown in FIG. 4, the refrigerator 1 further includes a sensor 31 positioned on a sidewall of the freezer liner 32. Specifically, in the embodiment shown in FIG. 4, the sensor 31 is positioned on the sidewall 38 of the freezer liner 32. Thermistors, thermocouples, and other types of temperature sensors known in the art are suitable for use as the sensors 21, 23, 25, 27, 29 and 31.

Figure 5:
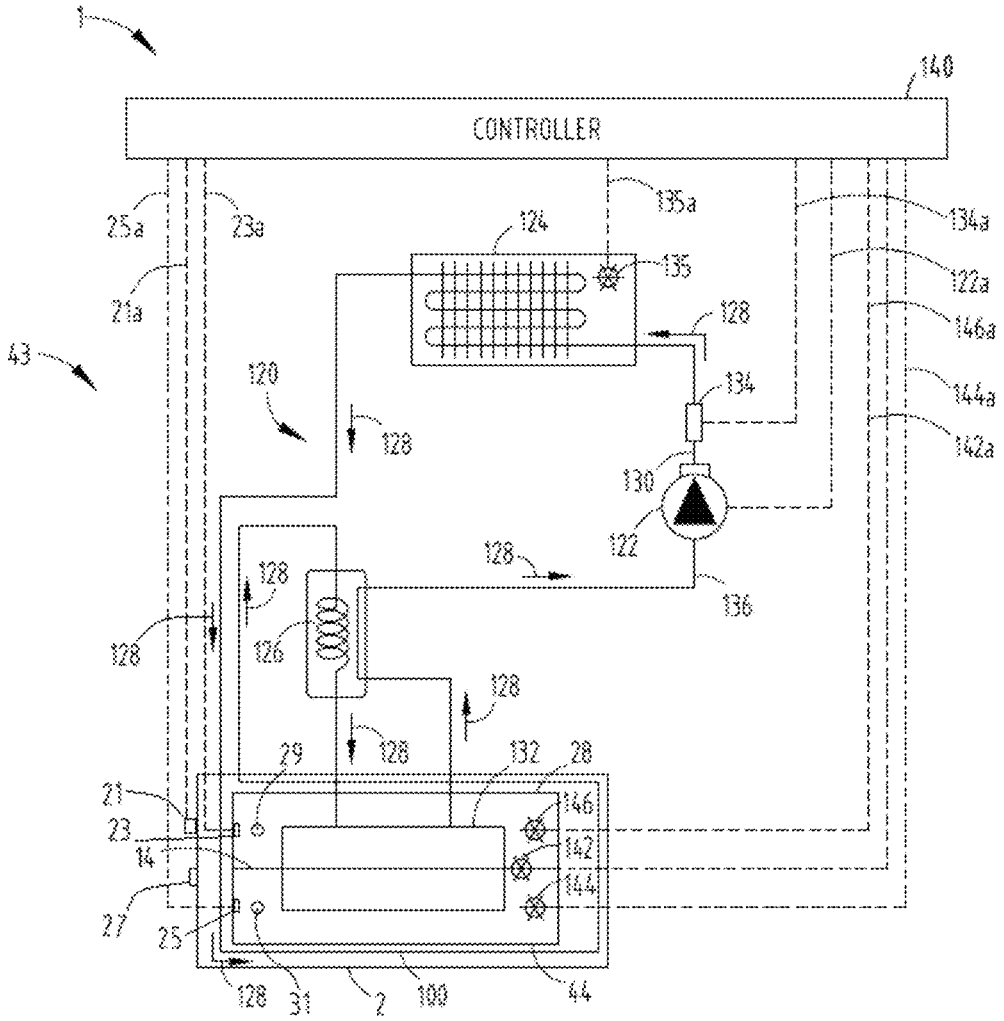
FIG. 5 is a schematic diagram of a refrigerant circuit.

Referring now to FIG. 5, a schematic illustration of refrigerator 1 and its component parts is provided. In FIG. 5, the refrigerator 1 is shown having a refrigerant circuit 120 for circulating refrigerant 128, a compressor 122, a condenser 124, a heat loop 100, a pressure reduction device 126, an evaporator 132, a compressor outlet line 130, a check valve 134, fans 135, 144, 146, 142 and a compressor inlet line 136. As further shown in FIG. 5, a controller 140 is provided. The controller 140 is contemplated to control the general operations of the refrigerator 1. In general, the controller 140 operates the compressor 122, for example, to maintain the refrigerator compartment 28 and the freezer compartment 44 at various temperatures desired by the user during a duty cycle of the compressor 122. A duty cycle of the compressor 122 can run for various time intervals as needed to reach desired temperature levels within the refrigerator compartment 28 (as measured by sensor 29) and the freezer compartment 44 (as measured by sensor 31).

The controller 140 is configured to receive and generate control signals via interconnecting wires provided in the form of leads arranged between and coupled to the refrigerator mechanical equipment 43. In particular, a lead 122*a* is arranged to couple the controller 140 with the compressor 122. Lead 134*a* is arranged to couple the controller 140 with the check valve 134. Lead 135*a* is arranged to couple the controller 140 with the condenser fan 135. Further, leads 142*a*, 144*a*, and 146*a* are arranged to couple the controller 140 with the evaporator fan 142, the freezer compartment fan 144, and the refrigerator compartment fan 146, respectively.

In the embodiment illustrated in FIG. 5, the controller 140 also relies on compartment temperature sensors to perform its intended function within the refrigerator 1. In particular, controller 140 is operably coupled to sensors 23 and 25 via leads 23*a* and 25*a*, respectively. As shown in FIGS. 4 and 5, the sensors 23 and 25 are arranged in the refrigerator compartment 28 and the freezer compartment 44, respectively. The sensors 23 and 25 are configured to generate signals indicative of temperature levels of the walls of the respective compartments 28 and 44 in which they are disposed, and send this data to the controller 140 for processing. Further, the sensor 21 is shown in FIG. 5 as provided on an exterior surface of the refrigerator 1, and is configured to provide temperature information for a particular exterior surface of the refrigerator 1. Information provided from the sensor 21 is delivered to the controller 140 via lead 21*a*. It is further contemplated that the sensors 21, 23 and 25 may be wirelessly coupled to the controller 140 for collecting and delivering signal information thereto. Further, the sensor 27 is shown in FIG. 5 as provided on an exterior surface of the refrigerator 1, and is configured to generate signals indicative of an ambient air temperature level from the environment in which the refrigerator 1 is disposed. It is contemplated that the sensor 27 can be a remote sensor that is spaced away from the refrigerator 1 and wirelessly connected to the controller 140. As such, the sensor 27 is configured to provide ambient temperature levels of a room in which the refrigerator 1 is disposed and forward the ambient temperature level sensed to the controller 140 by wired or wireless means for processing.

Further, the sensor 29 is shown in FIG. 5 as provided within the refrigerator compartment 28. As such, the sensor 29 is configured to provide ambient temperatures levels within the refrigerator compartment 28. Similarly, the sensor 31 is shown in FIG. 5 as provided within the freezer compartment 44. As such, the sensor 31 is configured to provide ambient temperatures levels within the freezer compartment 44. Both sensors 29 and 31 are contemplated to be in electrical communication with the controller 140 for providing ambient compartment temperature information thereto via wired or wireless means for processing.

The data received from the sensors 21, 23, 25, 27, 29 and 31 may be used in controlling the duty cycle of the compressor 122, such as runtime, duration, modulated power level, and other like parameters of the compressor 122 to cool the compartments 28, 44 of the refrigerator 1. The run time of the compressor 122 can be used to predict absolute vacuum. Here, the idea is to generate a graph of compressor run time for a particular product with respect to absolute vacuum pressure, and then use this data to predict pressure from compressor run time. Compressor run time changes as the vacuum pressure changes. For example, an increase in vacuum pressure causes the insulation quality to degrade, which will put more load on compressor, and lead to longer compressor run time intervals. Compressor run time can be combined with an external air temperature sensor (such as sensor 27) to compare the compressor run time with the external temperature sensed by sensor 27. If the external temperature is stable and the compressor run time is increasing over time, then it is an indication that the vacuum insulated cabinet structure is losing vacuum. If the compressor run time increases while the room temperature also increases, it is likely because of the increased heat load.

Using the information collected from the sensors 21, 23, 25, 27, 29 and 31, the controller 140 of the present concept is configured to provide data that can be used to measure the performance of the insulation of the insulating space 62 of the vacuum insulated cabinet structure 2. The performance of the insulating space 62 to insulate the compartments 28, 44 is related to the pressure maintained in the insulating space 62. Said differently, in the vacuum insulated cabinet structure 2, the pressure can be an initial negative pressure that gradually increases over the life of the refrigerator 1. Pressure increase in the vacuum insulated cabinet structure 2 of the refrigerator 1 can result in decreased insulation performance across the insulating space 62. This will result in the need for the compressor 122 to run more often, for longer time intervals per duty cycle, or both, in order to maintain desired temperatures in the compartments 28, 44.

The sensors 21, 23, 25, 27, 29 and 31 may, either alone or in combination, include temperature sensors configured to provide temperature values for the ambient air temperature from the environment in which the refrigerator 1 is located, the ambient refrigerator compartment temperature, the ambient freezer compartment temperature, and the temperature levels of the inner and outer walls of the vacuum insulated cabinet structure 2, as further described below. As used herein, the sensors 21, 23, 25, 27, 29 and 31 may be described as monitoring, sensing, detecting and providing data regarding the refrigerator compartments 28, 44, the ambient air around the refrigerator 1, or the exterior surfaces of the refrigerator 1. All such terms, and other like terms, are contemplated to indicate that the sensors 21, 23, 25, 27, 29 and 31 are configured to gather temperature level data and send the data to the controller 140 for processing.

The present concept seeks to measure the performance of the insulation of a vacuum insulated structure over time. Insulation quality of a vacuum insulated structure, such as the vacuum insulated cabinet structure 2 described above, depends upon the level of vacuum pressure maintained inside the vacuum insulated cabinet structure 2. Achieving target pressure during evacuation and monitoring vacuum pressure during product operation (i.e. the product life) is important. The present concept provides a solution on how to predict or calculate inside vacuum pressure by measuring wall temperatures on an appliance, such as the refrigerator 1 described above.

A common way to measure vacuum pressure inside a vacuum insulated cabinet structure is by using actual pressure sensors that are mounted on a vacuum insulated cabinet structure. There are multiple challenges in having an actual sensor mounted on the product. As stated above, the quality of insulation or the overall insulation performance depends upon the level of vacuum achieved inside an insulating space. Also we know that the temperature difference between the walls of the refrigerator 1 (inside and outside) depends upon quality of insulation. As such, vacuum pressure can be correlated with insulation quality or conductivity, and vacuum pressure can further be correlated with temperature differentials determined in and around the refrigerator 1.

Figure 6:
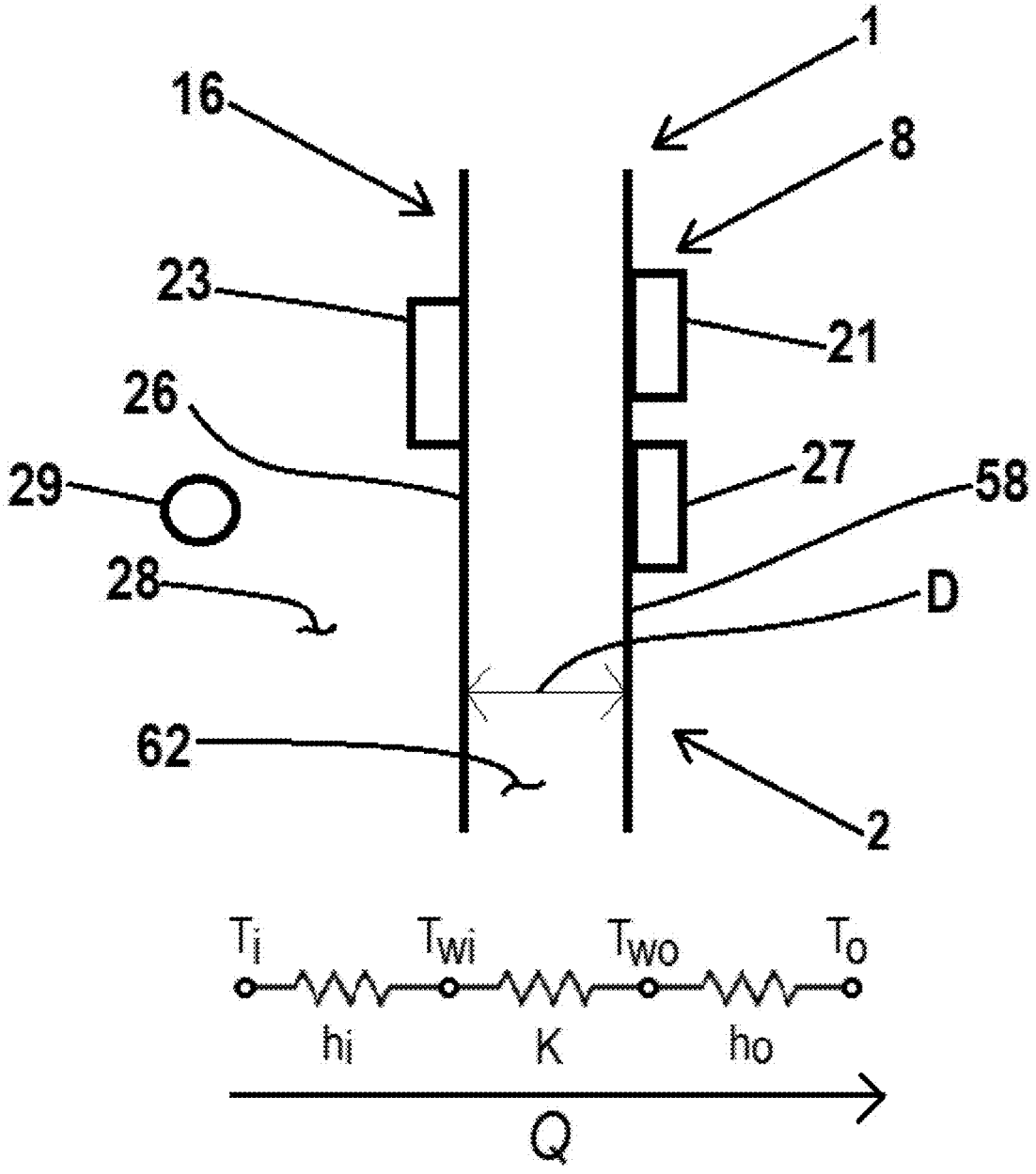
FIG. 6 is a zoomed-in view of the refrigerator of FIG. 4 taken at location VI.

Referring now to FIG. 6, a portion of the vacuum insulated cabinet structure 2 of the refrigerator 1 is shown, as taken from FIG. 4. The vacuum insulated cabinet structure 2 is shown in FIG. 6 as a double-walled structure. Specific to the view of FIG. 6, the insulating space 62 of the vacuum insulated cabinet structure 2 is shown positioned between the rear wall 26 of the refrigerator liner 16 and the rear wall 58 of the exterior wrapper 8. As noted above, the rear wall 26 of the refrigerator liner 16 includes a sensor 23 positioned thereon, such that the sensor 23 is disposed within refrigerator compartment 28 for measuring a temperature level of the rear wall 26 of the refrigerator liner 16. Also noted above, the rear wall 58 of the exterior wrapper 8 includes the sensor 21 disposed thereon. Being disposed on the rear wall 58 of the exterior wrapper 8, the sensor 21 is positioned to sense a temperature level of an exterior wall of the vacuum insulated structure 2. Also noted above, the rear wall 58 of the exterior wrapper 8 includes the sensor 27 disposed thereon. In this way, the sensor 27 is positioned to sense ambient temperature levels for the environment in which the vacuum insulated cabinet structure 2 is disposed. Also noted above, the refrigerator liner 16 includes a sensor 29 disposed thereon. The sensor 29 is positioned to sense ambient temperature levels of the refrigerator compartment 28.

The sensors 21, 23, 27 and 29 are configured such that a first temperature sensor (sensor 23) is positioned on a first side (rear wall 26 of refrigerator liner 16) of the insulating space 62, and a second temperature sensor (sensor 21) is positioned on a second side (rear wall 58 of the exterior wrapper 8) of the insulating space 62. Thus, the first side of the insulating space 62 is spaced-apart from and opposed to the second side of the insulating space 62. The insulating space 62 is shown as having a distance D provided between the rear walls 26, 58 of the refrigerator liner 16 and the exterior wrapper 8, respectively.

As further shown in FIG. 6, the sensor 29 is configured to measure an ambient temperature level of the refrigerated air of the refrigerator compartment 28, which is expressed herein as temperature level ($T_i$). The sensor 23 is configured to measure the temperature level of the inner wall 26 of the insulating space 62, which is expressed herein as temperature level ($T_{wi}$). The temperature levels from ($T_i$) to ($T_{wi}$) is typically an increase in temperature, which is related to a convective heat transfer coefficient ($h_i$). As further shown in FIG. 6, the sensor 21 is configured to measure the temperature level of the outer wall 58 of the insulating space 62, which is expressed herein as temperature level ($T_{wo}$). The temperature levels from ($T_{wi}$) to ($T_{wo}$) is typically an increase in temperature, which is related to conductivity (K) of the insulating space 62. As further shown in FIG. 6, the sensor 27 is configured to measure an ambient temperature level of the room in which the refrigerator 1 is disposed, which is expressed herein as temperature level ($T_o$). The temperature levels from ($T_{wo}$) to ($T_o$) is typically an increase in temperature, which is related to a convective heat transfer coefficient (ho). Thus, Q is a constant number showing an overall heat transfer coefficient from the ambient temperature ($T_i$) of the refrigerator compartment 28 to the ambient temperature level ($T_o$) of the room in which the refrigerator 1 is disposed.

As further noted above, the insulating space 62 is provided at a negative pressure in the vacuum insulated cabinet structure 2 in order to provide insulating properties for the refrigerator compartment 28. As vacuum pressure inside the insulating space 62 increases over the life of the refrigerator 1 from its initial evacuation, the thermal conductivity through the insulating space 62 also increases. As a corollary, a temperature differential between temperature levels sensed by the sensors 21, 23 at the inner and outer walls of the refrigerator compartment 28 drops as thermal conductivity and vacuum pressure increase within the insulating space 62. Thus, vacuum pressure (P) within the insulating space 62 is related to a thermal conductivity level (K) provided within the insulating space 62. The vacuum pressure (P) and the thermal conductivity level (K) provided within the insulating space 62 are related to a temperature differential calculated between the temperature levels sensed by the sensors 21, 23 at the inner and outer walls of the refrigerator compartment 28. The temperature differential is provided by the sensor 21 measuring the temperature level ($T_{wo}$) of the exterior wall of the refrigerator compartment 28, and the sensor 23 measuring the temperature level ($T_{wi}$) of the interior wall of the refrigerator compartment 28. The temperature level ($T_{wo}$) sensed by the sensor 21 is compared to the temperature level ($T_{wi}$) sensed by the sensor 23 disposed within the refrigerator compartment 28. As such, a temperature differential level ($\Delta T$) is calculated by subtracting the temperature level ($T_{wi}$) sensed by the sensor 23 (temperature level of the interior wall of the refrigerator compartment 28) from the temperature level ($T_{wo}$) sensed by the sensor 21 (temperature level of the exterior wall of the refrigerator compartment 28).

As thermal conductivity (K) increases within the insulating space 62, the difference between the interior wall temperature level ($T_{wi}$) sensed in the refrigerator compartment 28 and the exterior wall temperature level ($T_{wo}$) sensed on the exterior wall of the vacuum insulated cabinet structure 2 will lessen. Said differently, the ability of the refrigerator 1 to keep the refrigerator compartment 28 at a refrigerated level will decrease as the performance of the insulating space 62 decreases. The performance of the insulating space 62 decreases as the vacuum pressure (P) within the insulating space 62 increases along with the thermal conductivity (K). As such, the vacuum pressure (P) and the thermal conductivity level (K) provided within the insulating space 62 are related to the calculated temperature differential ($\Delta T$).

For example, if the refrigerator 1 is disposed within an environment in which the ambient temperature is 25° C., then this ambient temperature level ($T_o$) will be sensed by the sensor 27 which is configured to sense the ambient temperature of the environment in which the refrigerator 1 is disposed (e.g. a kitchen). If the refrigerator compartment 28 of the refrigerator 1 is refrigerated to 3° C., then this refrigerated temperature level ($T_i$) will be sensed by the sensor 29 positioned within the refrigerator compartment 28. For this example, the resulting temperature differential ($\Delta T$) is 22° C. Thus, the resulting temperature differential ($\Delta T$) can be calculated by the following formula:

$$\Delta T = T_o - T_i$$

For the example given above, the resulting temperature differential ($\Delta T$) of 22° C. may be described as a data point "Delta T1" that is provided by a temperature differential sensed between the sensors 27, 29 at a first point in time. If the resulting temperature differential ($\Delta T$) is equal to Delta T1, then the vacuum pressure (P) is provided by the data point "P1" which correlates to the vacuum pressure (P) within the insulating space 62 of the vacuum insulated cabinet structure 2 at the first point in time. If the resulting temperature differential ($\Delta T$) is equal to Delta T1, then the thermal conductivity (K) is provided by the data point "K1" which correlates to the thermal conductivity (K) within the insulating space 62 of the vacuum insulated cabinet structure 2 at the first point in time.

At a second point in time, over the life of the refrigerator 1, the resulting temperature differential will likely be a lower number than 22° C. as the vacuum pressure (P) within the vacuum insulated cabinet structure 2 rises along with the thermal conductivity (K). This second temperature differential can be provided as a data point "Delta T2" which correlates to a vacuum pressure data point of "P2" for the vacuum pressure of the vacuum insulated cabinet structure 2 at the second point in time. Similarly, if the resulting temperature differential ($\Delta T$) is equal to Delta T2, then the thermal conductivity (K) is provided by the data point "K2" which correlates to the thermal conductivity (K) within the insulating space 62 of the vacuum insulated cabinet structure 2 at the second point in time.

The steps described above can be repeated multiple times to provide a plurality of temperature differential levels, a plurality of vacuum pressure levels, and a plurality of thermal conductivity levels over time. With this information, a curve can be derived mathematically using vacuum pressure levels (P1, P2, etc.) vs. thermal conductivity levels (K1, K2 etc.) and the conductivity equation and later can be validated through testing.

It is further contemplated that a series of temperature levels can be compiled by taking multiple temperature readings by the sensors 27, 29 at the first period in time to provide multiple temperature differentials that can be calculated by the controller 140 (FIG. 5). The controller 140 can further calculate an average temperature differential using data from the series of temperature levels sensed during an off-duty cycle of the compressor 122. This process can be repeated for multiple periods in time to provide vacuum pressure levels and thermal conductivity levels that are averaged at those periods in time.

With further reference to the example given above, and with further reference to FIG. 6, we have the following conditions: 1) the sensor 29 has measured the inside ambient temperature level ($T_i$) of the refrigerator compartment 28 at 3° C.; 2) the sensor 27 has measured the outside ambient temperature level ($T_o$) of the space in which the refrigerator 1 is disposed at 25° C.; 3) the thickness (D) of the insulating space 62 or the distance between interior wall 26 and exterior wall 58 is 30 mm; 4) the conductivity of the insulation (K) is 5 mw/mk; 5) the convective heat transfer coefficient ($h_i$) from the ambient temperature ($T_i$) of the refrigerator compartment 28 to the temperature level ($T_{wi}$) of the rear wall 26 of the liner 16 of the refrigerator compartment 28 is 15 W/(m$^2$ K); and 6) the convective heat transfer coefficient ($h_o$) from the temperature level ($T_{wo}$) of the rear wall 58 of the exterior wrapper 8 to the ambient air temperature ($T_o$) is 8.28 W/(m$^2$ K). With this information, we can calculate the overall heat transfer coefficient (Q) using the following formula:

$$Q = \frac{(To - Ti)}{\left(\frac{1}{hi} + \frac{D}{K} + \frac{1}{ho}\right)}$$

The overall heat transfer coefficient (Q) demonstrates how heat is conducted through a series of resistant mediums, as shown in FIG. 6.

In the above equation, using the parameters set forth in this example, Q=3.56 W/m$^2$. With Q calculated, we can now determine the temperatures of the inner wall ($T_{wi}$) and the outer wall ($T_{wo}$) using the following formulas, respectively:

$$\Delta T = \frac{Q}{hi}\Delta T = \frac{Q}{ho} \text{ and}$$

$$\Delta T = \frac{Q}{hi}\Delta T = \frac{Q}{ho}$$

In the first equation, $\Delta T = T_{wi} - T_i$. As such, for the first equation, 3.56 W/m$^2$/15 W/(m$^2$ K)=.24° C. Therefore, with the ambient temperature level ($T_i$) inside the refrigerator compartment 28 being known as 3° C., we can deduce that the temperature level ($T_{wi}$) of the wall inside the refrigerator compartment 28 is 3.24° C. In the second equation, $\Delta T = T_{wo} - T_o$. As such, for the second equation, 3.56 W/m$^2$/8.28 W/(m$^2$ K)=43° C. Therefore, with the ambient temperature level ($T_o$) of the environment in which the refrigerator 1 is disposed being known as 25° C., we can deduce that the temperature level ($T_{wo}$) of the exterior wall outside the refrigerator compartment 28 is 24.57° C. Thus, for any refrigerated system, the present concept can calculate an overall heat transfer coefficient (Q) if we are provided with: 1) two temperature levels selected from the group consisting of an ambient temperature of a refrigerator compartment ($T_i$), an interior wall temperature level ($T_{wi}$) of an insulating space, an exterior wall temperature level ($T_{wo}$) of an insulating space, and an outside ambient temperature level ($T_o$); and the resistance ($h_i$, K or $h_o$) between the known temperature levels. For example, we can determine (Q) if we have the ambient temperature ($T_i$) of the refrigerator compartment 28 and the temperature level ($T_{wi}$) of the rear wall 26 of the liner 16 of the refrigerator compartment 28, and the resistance between them ($h_i$). Similarly, we can determine (Q) if we have the temperature level ($T_{wi}$) of the rear wall 26 of the liner 16 of the refrigerator compartment 28 and the temperature level ($T_{wo}$) of the rear wall 58 of the exterior wrapper 8 of the refrigerator 1, and the resistance between them (K). Still further, we can determine (Q) if we have the temperature level ($T_{wo}$) of the rear wall 58 of the exterior wrapper 8 of the refrigerator 1 and the outside ambient temperature level ($T_o$), and the resistance between them ($h_o$).

With Q calculated, we can use either of the formulas noted below to determine unknown variables:

$$\Delta T = \frac{Q}{hi} \text{ or } \Delta T = \frac{Q}{ho} \text{ or } \Delta T = \frac{Q}{(K/D)}$$

Further, if (K) is unknown and the interior wall temperature level ($T_{wi}$) of an insulating space, the exterior wall temperature level ($T_{wo}$) of an insulating space, and (Q) are known, we can use the following formula to calculate unknowns:

$$(Two - Twi) = \frac{Q}{(K/D)}$$

In the above example, the temperature level ($T_{wi}$) of the wall 26 inside the refrigerator compartment 28 was calculated to be 3.24° C. Further, the temperature level ($T_{wo}$) of the exterior wall 58 outside the refrigerator compartment 28 was calculated to be 24.57° C. With this information, along with the thickness of the insulating space 62 and knowing Q to be 3.56 W/m$^2$, we can calculate the conductivity (K) of the insulating space 62 using the equation below, wherein:

$$(Two - Twi) = \frac{Q}{(K/D)};$$

$$\left(\frac{K}{30}\right)(21.33) = 3.56;$$

$$K = \left(\frac{3.56}{21.33}\right)30;$$

$$\text{so } K = 5 \text{ mW/mK}$$

Figure 7:
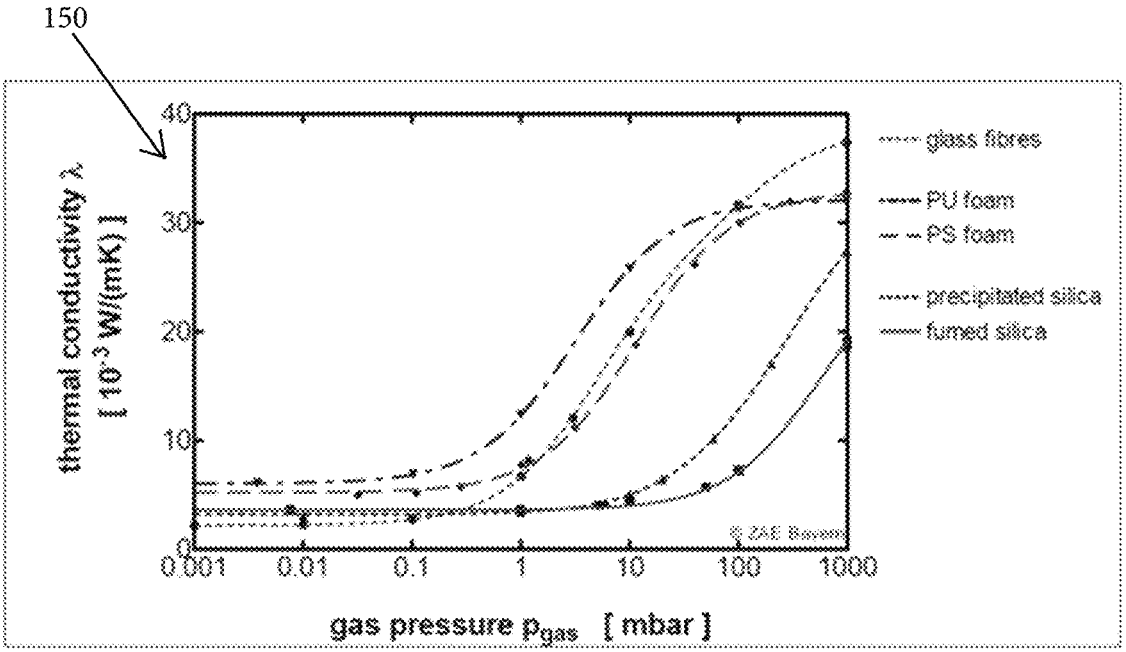
FIG. 7 is a graphical representation plotting thermal conductivity v. vacuum pressure.

Thus, as noted above, Delta T ($\Delta T$) of the interior and exterior walls (26, 58) of the insulating space 62 is correlated to the conductivity (K) of the insulating space 62. The conductivity (K) of the insulating space 62 is further correlated to the absolute vacuum pressure P inside the vacuum insulated cabinet structure 2. The relationship between the conductivity (K) of the insulating space 62 and the vacuum pressure P inside the vacuum insulated cabinet structure 2 is illustrated in the reference chart 150 shown in FIG. 7. As shown in the reference chart 150 of FIG. 7, the relationship between the conductivity (K) of the insulating space 62 and the vacuum pressure P inside the insulating space 62 of the vacuum insulated cabinet structure 2 is plotted as an S-curve. The reference chart 150 of FIG. 7 includes the conductivity of an insulating space as provided with various types of insulation (fumed silica, precipitated silica, polystyrene foam, polyurethane foam, and glass fibers). In this way, the reference chart 150 of FIG. 7 plots the conductivity of an insulating space through a plurality of resistive mediums (fumed silica, precipitated silica, polystyrene foam, polyurethane foam, and glass fibers) as a function of vacuum pressure P inside the insulating space. The S-curve of the reference chart 150 of FIG. 7 forms its S-curve shape because the thermal conductivity is relatively slow to change in the initial stages of pressure increase within the insulating space 62. As pressure begins to increase from 1 mbar to 10 mbar within the insulating space 62, the conductivity increases rapidly, thereby creating an upward slope that forms the middle part of the "s" in the S-curve of the reference chart 150. This point of increased conductivity may be referred to herein as the point of inflection. After the point of inflection, the conductivity begins to plateau, forming the upper part of the "s" of the S-curve of the reference chart 150, which may be referred to herein as the upper asymptote. At this point, the insulation performance has significantly degraded. Thus, as shown in the reference chart 150 of FIG. 7, the conductivity of insulation is proportional to vacuum pressure, and the relationship is nonlinear. Using the information provided in the reference chart 150 of FIG. 7, a model is provided from which we can estimate vacuum pressure P within the insulating space 62 once we have determined the conductivity (K) within the insulating space 62. So, the present concept involves finding the conductivity (K) of the insulating space using Delta T ($T_{wo}-T_{wi}$), and then finding Pressure (P) from the calculated conductivity (K) using the reference chart 150 provided in FIG. 7. It is contemplated that the values of the reference chart 150 can be stored in the controller 140 for estimating pressure in an insulating space.

According to one aspect, a method of measuring insulation performance in a vacuum insulated cabinet structure includes the steps of: (1) providing a refrigerator having a vacuum insulated cabinet structure with a storage compartment and an insulating space having a thickness, a first sensor positioned on an interior wall of the storage compartment, a second sensor positioned on an exterior wall of the vacuum insulated cabinet structure, a third sensor positioned within the storage compartment, and a controller operably coupled to the first, second and third sensors; (2) sensing a first temperature level of the interior wall of the storage compartment using the first sensor; (3) sensing an ambient temperature level within the storage compartment using the third sensor; (4) sensing a second temperature level of the exterior wall of the storage compartment using the second sensor; (5) calculating an overall heat transfer coefficient (Q) using the ambient temperature level, the first temperature level, and a convective heat transfer coefficient for the interior wall of the storage compartment; (6) calculating a temperature differential between the second temperature level and the first temperature level; (7) determining a conductivity level (K) using the temperature differential, the overall heat transfer coefficient (Q) and the thickness of the insulating space; and (8) determining a pressure level (P) within the insulating space using the conductivity level (K).

According to another aspect, the step of determining a pressure level (P) within the insulating space using the conductivity level (K) further includes, referencing a reference chart. The reference chart plots conductivity vs. vacuum pressure.

According to another aspect, the reference chart includes conductivity levels through a plurality of resistive mediums.

According to another aspect, the resistive mediums include one or more mediums selected from the group consisting of fumed silica, precipitated silica, polystyrene foam, polyurethane foam, and glass fibers.

According to another aspect, the insulating space includes a polyurethane foam insulating material disposed therein.

According to another aspect, the second sensor is positioned on the exterior wall of the vacuum insulated cabinet structure in a manner that is opposed to a position of the first sensor on the interior wall of the storage compartment.

According to yet another aspect, a method of measuring pressure within a vacuum insulated cabinet structure includes the steps of (i) providing a vacuum insulated cabinet structure having a storage compartment and an insulating space positioned between interior and exterior walls of the storage compartment, a first temperature sensor positioned on the interior wall of the storage compartment, a second temperature sensor positioned on the exterior wall of the vacuum insulated cabinet structure, a third temperature sensor positioned outside of storage compartment; (ii) sensing a first temperature level of the interior wall of the storage compartment using the first temperature sensor; (iii) sensing a second temperature level of the exterior wall of the storage compartment using the second temperature sensor; (iv) calculating a first temperature differential between the second temperature level and the first temperature level; (v) sensing an ambient temperature level for an environment in which the storage compartment is disposed using the third temperature sensor; (vi) calculating an overall heat transfer coefficient (Q) using the ambient temperature level, the first temperature level, and a convective heat transfer coefficient for the exterior wall of the storage compartment; (vii) determining a first conductivity level (K) using the first temperature differential, the overall heat transfer coefficient (Q) and a thickness of the insulating space; and (viii) determining a first pressure level (P) within the insulating space using the first conductivity level (K).

According to another aspect, the method includes the step of (ix) repeating steps (ii)-(iv) to provide a plurality of temperature differential levels.

According to another aspect, the method includes the step of (x) calculating an average temperature differential level using the plurality of temperature differential levels.

According to another aspect, the method includes the step of (xi) determining an average conductivity level using the average temperature differential, the overall heat transfer coefficient (Q) and the thickness of the insulating space.

According to another aspect, the method includes the step of (xii) determining an average pressure level within the insulating space using the average conductivity level (K).

According to another aspect, the step of determining a first pressure level (P) using the first conductivity level (K) further includes, referencing a reference chart, wherein the reference chart plots conductivity as a function of vacuum pressure.

According to another aspect, the reference chart includes conductivity levels through a plurality of resistive mediums.

According to another aspect, the resistive mediums include one or more mediums selected from the group consisting of fumed silica, precipitated silica, polystyrene foam, polyurethane foam, and glass fibers.

According to another aspect, the third temperature sensor is positioned on the exterior wall of the storage compartment.

According to another aspect, the third temperature sensor is spaced-apart from the vacuum insulated cabinet structure.

According to yet another aspect, a method of measuring insulation performance on a vacuum insulated cabinet structure includes the steps of: (i) providing a vacuum insulated cabinet structure having an insulation space surrounding a storage compartment, a first temperature sensor positioned on a first side of the insulation space, a second temperature sensor positioned on a second side of the insulation space, a third temperature sensor positioned within the storage compartment, and a controller operably coupled to the first, second and third temperature sensors; (ii) sensing a first temperature level (T1) using the first temperature sensor; (iii) sensing a second temperature level (T2) using the second temperature sensor; (iv) calculating a temperature differential level ($\Delta T$) by subtracting the first temperature level (T1) from the second temperature level (T2); (v) sensing an ambient temperature level ($T_i$) within the storage compartment using the third temperature sensor; (vi) calculating an overall heat transfer coefficient (Q) using the ambient temperature level ($T_i$), the first temperature level (T1), and a convective heat transfer coefficient for the first side of the storage compartment; and (vii) determining a first conductivity level (K) using the temperature differential, the overall heat transfer coefficient (Q) and a thickness of the insulating space.

According to another aspect, the method includes the step of (viii) determining a first pressure level (P) within the insulating space using the first conductivity level (K).

According to another aspect, the method includes the step of (viii) repeating steps (ii)-(vii) a separate time intervals to provide a plurality of conductivity levels; and (ix) determining a first pressure level (P) within the insulating space using the first conductivity level (K).

According to another aspect, the step of determining a first pressure level (P) within the insulating space using the first conductivity level (K) further includes, referencing a reference chart, wherein the reference chart plots conductivity vs. vacuum pressure.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigerator, comprising:

a vacuum insulated cabinet structure having a refrigerator compartment and an exterior wrapper with an insulating space disposed therebetween, wherein the refrigerator compartment is positioned within the vacuum insulated cabinet structure and includes an interior wall, and further wherein the exterior wrapper includes an exterior wall that is separated from the interior wall of the refrigerator compartment to define a thickness of the insulating space;

a first sensor positioned on the interior wall of the refrigerator compartment, wherein the first sensor is configured to sense a first temperature level of the interior wall of the refrigerator compartment;

a second sensor positioned on the exterior wall of the exterior wrapper, wherein the second temperature sensor is configured to sense a second temperature level of the exterior wall of the exterior wrapper;

a third sensor positioned within the refrigerator compartment, wherein the third temperature sensor is configured to sense an ambient temperature level within the refrigerator compartment; and a controller operably coupled to the first, second and third sensors for receiving temperature level data therefrom, wherein the controller is configured to:

calculate an overall heat transfer coefficient (Q) using the ambient temperature level, the first temperature level, and a convective heat transfer coefficient for the interior wall of the storage compartment;

calculate a temperature differential between the second temperature level and the first temperature level;

determine a conductivity level (K) using the temperature differential, the overall heat transfer coefficient (Q) and the thickness of the insulating space; and determine a pressure level (P) within the insulating space using the conductivity level (K).

2. The refrigerator of claim 1, wherein the insulating space includes a polyurethane foam insulating material disposed therein.

3. The refrigerator of claim 1, wherein the second sensor is positioned on the exterior wall of the exterior wrapper of the vacuum insulated cabinet structure in a manner that is opposed to a position of the first sensor on the interior wall of the refrigerator compartment.

4. The refrigerator of claim 1, including:

a fourth sensor positioned on the exterior wall, wherein the fourth sensor is configured to sense an ambient temperature level for an environment in which the vacuum insulated cabinet structure is disposed.

5. The refrigerator of claim 4, including:

a freezer compartment positioned within the vacuum insulated cabinet structure and having an interior wall; and a fifth sensor positioned on the interior wall of the freezer compartment, wherein the fifth sensor is configured to sense a temperature level of the interior wall of the freezer compartment.

6. The refrigerator of claim 5, including:

a sixth sensor positioned within the freezer compartment, wherein the sixth sensor is configured to sense an ambient temperature level within the freezer compartment.

7. A vacuum insulated cabinet structure, comprising:

a storage compartment and an insulating space positioned between interior and exterior walls of the storage compartment;

a first temperature sensor positioned on the interior wall of the storage compartment, wherein the first temperature sensor is configured to sense a first temperature level of the interior wall of the storage compartment;

a second temperature sensor positioned on the exterior wall of the storage compartment, wherein the second temperature sensor is configured to sense a second temperature level of the exterior wall of the storage compartment;

a third temperature sensor positioned outside of the storage compartment, wherein the third temperature sensor is configured to sense an ambient temperature level for an environment in which the storage compartment is disposed;

a controller operably coupled to the first, second and third temperature sensors for receiving temperature level data therefrom, wherein the controller is configured to:

(i) calculate a first temperature differential between the second temperature level and the first temperature level;

(ii) calculate an overall heat transfer coefficient (Q) using the ambient temperature level, the second temperature level, and a convective heat transfer coefficient for the exterior wall of the storage compartment;

(iii) determine a first conductivity level (K) using the first temperature differential, the overall heat transfer coefficient (Q) and a thickness of the insulating space; and (iv) determine a first pressure level (P) within the insulating space using the first conductivity level (K).

8. The vacuum insulated cabinet structure of claim 7, wherein the controller is further configured to receive a plurality of temperature differential levels and calculate an average temperature differential using the plurality of temperature differential levels.

9. The vacuum insulated cabinet structure of claim 8, wherein the controller is further configured to calculate an average conductivity level using the average temperature differential, the overall heat transfer coefficient (Q) and the thickness of the insulating space.

10. The vacuum insulated cabinet structure of claim 9, wherein the controller is further configured to determine an average pressure level within the insulating space using the average conductivity level (K).

11. The vacuum insulated cabinet structure of claim 7, wherein the controller includes a reference chart that chart plots conductivity as a function of vacuum pressure.

12. The vacuum insulated cabinet structure of claim 11, wherein the reference chart includes conductivity levels through a plurality of resistive mediums.

13. The vacuum insulated cabinet structure of claim 12, wherein the resistive mediums include one or more mediums selected from the group consisting of fumed silica, precipitated silica, polystyrene foam, polyurethane foam, and glass fibers.

14. The method of claim 7, wherein the third temperature sensor is positioned on the exterior wall of the storage compartment.

15. The method of claim 7, wherein the third temperature sensor is spaced-apart from the vacuum insulated cabinet structure.

16. A method of measuring insulation performance, the method comprising the steps of:

(i) providing a storage compartment surrounded by an insulation space, a first temperature sensor positioned on a first side of the insulation space, a second temperature sensor positioned on a second side of the insulation space, a third temperature sensor positioned within the storage compartment, and a controller operably coupled to the first, second and third temperature sensors;

(ii) sensing a first temperature level (T1) using the first temperature sensor;

(iii) sensing a second temperature level (T2) using the second temperature sensor;

(iv) calculating a temperature differential (ΔT) by subtracting the first temperature level (T1) from the second temperature level (T2);

(v) sensing an ambient temperature level ($T_i$) within the storage compartment using the third temperature sensor;

(vi) calculating an overall heat transfer coefficient (Q) using the ambient temperature level ($T_i$), the first temperature level (T1), and a convective heat transfer coefficient for the first side of the storage compartment;

(vii) determining a first conductivity level (K) using the temperature differential (ΔT), the overall heat transfer coefficient (Q) and a thickness of the insulating space; and (viii) determining a first pressure level (P) within the insulating space using the first conductivity level (K).

17. A vacuum insulated cabinet structure configured to implement the steps of the method of measuring insulation performance according to claim 16.

* * * * *